US006941876B1

(12) United States Patent
Traino

(10) Patent No.: US 6,941,876 B1
(45) Date of Patent: Sep. 13, 2005

(54) ADJUSTABLE READING TABLE

(76) Inventor: Louis M. Traino, 96 Holiday Rd., Rolchester, NY (US) 14623

( * ) Notice: Subject to any disclaimer, the term of this patent is extended or adjusted under 35 U.S.C. 154(b) by 123 days.

(21) Appl. No.: 10/662,174

(22) Filed: Sep. 15, 2003

Related U.S. Application Data

(60) Provisional application No. 60/410,901, filed on Sep. 16, 2002.

(51) Int. Cl.[7] ..... A47F 5/12
(52) U.S. Cl. ..... 108/6; 108/50.11; 108/9
(58) Field of Search ..... 109/6, 7, 9, 12, 109/19, 50.11, 49, 43, 1; 248/371, 372.1, 248/456, 451

(56) References Cited

U.S. PATENT DOCUMENTS

| | | | | | |
|---|---|---|---|---|---|
| 706,228 | A | * | 8/1902 | Fleming | 248/456 |
| 778,872 | A | * | 1/1905 | Lugosch | 269/16 |
| 2,017,518 | A | * | 10/1935 | Wagner | 248/456 |
| 2,328,471 | A | * | 8/1943 | Leffel | 108/6 |
| 2,547,642 | A | * | 4/1951 | Heuser | 108/147.21 |
| 2,865,132 | A | * | 12/1958 | Fleming | 281/51 |
| 3,094,948 | A | * | 6/1963 | Clow | 108/10 |
| 3,615,088 | A | * | 10/1971 | Compton | 108/9 |
| 3,669,227 | A | * | 6/1972 | Alford | 190/11 |
| 3,768,768 | A | * | 10/1973 | Benlian | 248/456 |
| 3,805,710 | A | * | 4/1974 | Leshem | 108/6 |
| 3,991,967 | A | * | 11/1976 | Sack | 248/448 |
| 4,718,630 | A | * | 1/1988 | Richard | 248/444.1 |
| 5,005,669 | A | * | 4/1991 | Umebara et al. | 108/6 |
| 5,263,423 | A | * | 11/1993 | Anderson | 108/43 |
| 5,417,168 | A | * | 5/1995 | Soper | 108/6 |
| 5,810,316 | A | * | 9/1998 | Eby | 248/451 |

* cited by examiner

*Primary Examiner*—Jose V. Chen
(74) *Attorney, Agent, or Firm*—Robert J. Bird

(57) ABSTRACT

A reading table includes a tabletop is connected to a frame for pivotal movement up and down among selected inclined positions. The frame is supported on front and back legs, the front legs being connected for pivotal movement between "normal" forward positions and "pushed-back" positions when the table is pulled into a chair and over its seating surface. The table also includes a pair of props, shorter than the front legs, to act in place of the front legs by standing upon the seating surface when the table is pulled in over the seating surface. The legs and props are telescoped for height adjustability among a discrete number of snap lock positions. Left and right levers are pivotally mounted on left and right ends of the frame, each of them spring-biased up against a ratchet on the underside of the tabletop to releasably support the tabletop at a selected incline relative to the frame. A crossbar is slidable up and down on the tabletop to position objects such as a book. The crossbar includes left and right hold-downs which are in turn slidable along the crossbar, each of them including a spring loaded arm biased downward to hold a book open, and pivotable up and away from the tabletop.

6 Claims, 3 Drawing Sheets

ADJUSTABLE READING TABLE

CROSS-REFERENCE TO RELATED APPLICATION

This application relates to my copending Provisional Patent Applicaton No. 60/410,901 which was filed on Sep. 16, 2002. That filing date is claimed for this application.

BACKGROUND OF THE INVENTION

This invention is a reading table or the like. More specifically, the invention is a reading table adapted for use while sitting in a relatively reclined position, on a couch or easy chair for example.

It is a common practice for persons, especially elderly persons, to pull a "card table" up close to an easy chair, the card table to serve as a reading table or the like. This does not give the user an entirely satifactory reading arrangement, however. The table legs make it impossible to pull the table in close enough to the user for real comfort. The table is pulled in toward the chair until two of the table legs come into abutment with the chair, and that is as close in as the table can be pulled.

The object of this invention is to provice a reading table that can be pulled in toward the user and, to an extent, over the user's chair and as close to the user as desired for comfort.

SUMMARY OF THE INVENTION

In summary, this invention is reading table of which the tabletop is connected to a frame for pivotal movement up and down among selected inclined positions. The frame is supported on front and back legs, the front legs being connected for pivotal movement between "normal" forward positions and "pushed-back" positions when the table is pulled into a chair and over its seating surface. The table also includes a pair of props, shorter than the front legs, to act in place of the front legs by standing upon the seating surface when the table is pulled in over the seating surface. The legs and props are telescoped for height adjustability among a discrete number of snap lock positions. Left and right levers are pivotally mounted on left and right ends of the frame, each of them spring-biased up against a ratchet on the underside of the tabletop to releasably support the tabletop at a selected incline relative to the frame. A crossbar is slidable up and down on the tabletop to position objects such as a book. The crossbar includes left and right hold-downs which are in turn slidable along the crossbar, each of them including a spring loaded arm biased downward to hold a book open, and pivotable up and away from the tabletop.

DRAWING

DESCRIPTION

Figure 1:
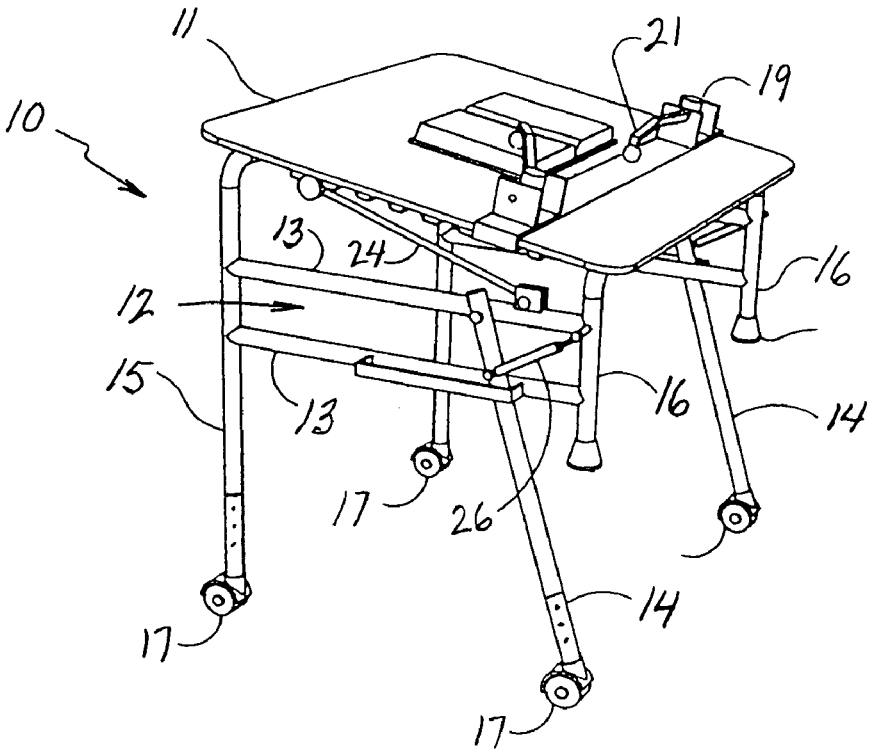
FIG. 1 is a perspective view of a reading table of my invention.

With reference now to the drawing, my reading table 10 includes a tabletop 11 pivotally connected to a frame 12 for pivotal movement up and down between a relatively horizontal position and selected inclined positions, up to about 80° from horizontal, as desired. The frame 12 is a box-like framework of generally orthogonal frame members 13, supported on front and back legs 14, 15. As indicated in FIG. 1, the legs are telescoped for height adjustability among a discrete number of snap lock positions. The legs include casters 17 for easy rolling on floor or carpet. The pivotal connection of tabletop 11 and frame 12 is along the front of the tabletop and frame (from user's left to right).

Figure 2:
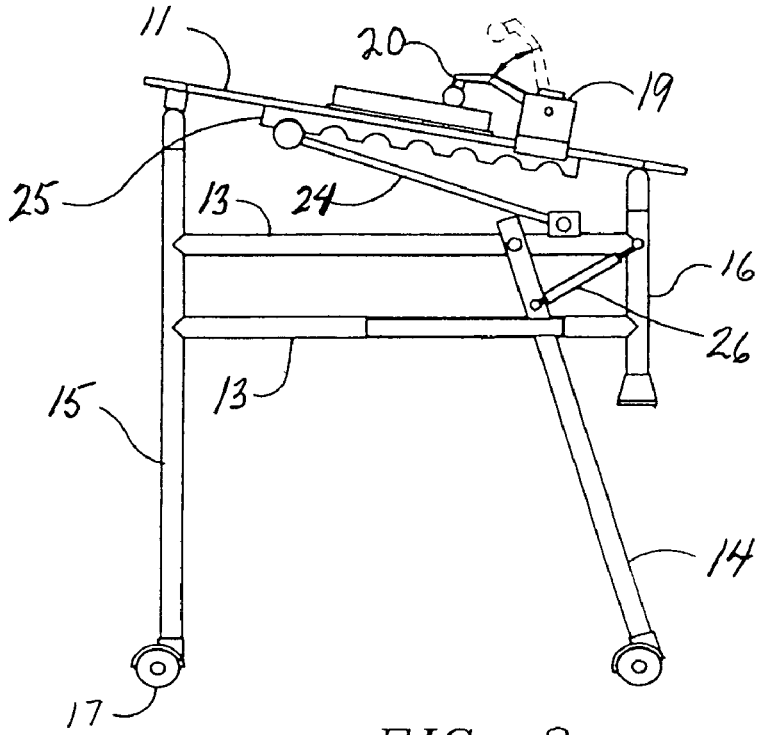
FIGS. 2, 3, 4 are left side views of the table of FIG. 1.
Figure 4:
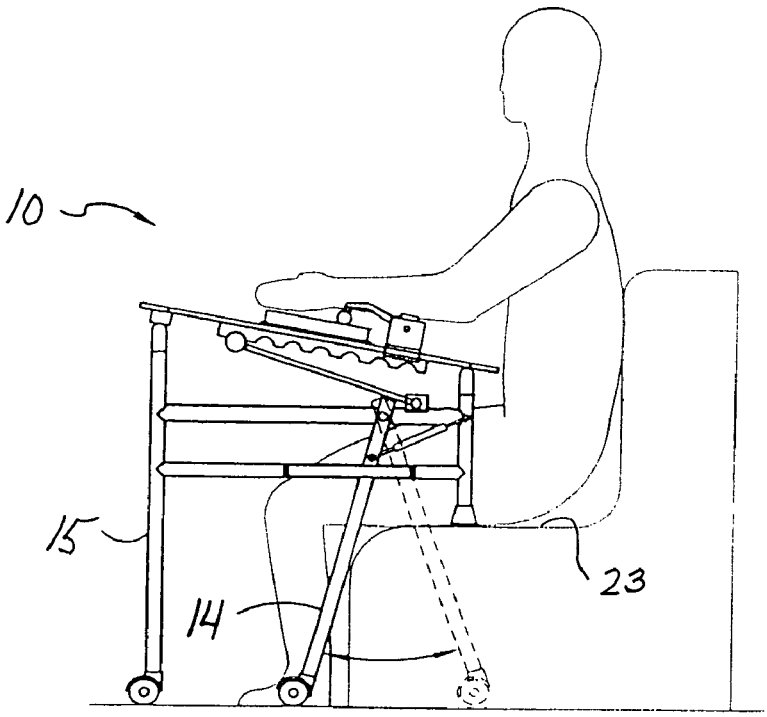
Figure 5:
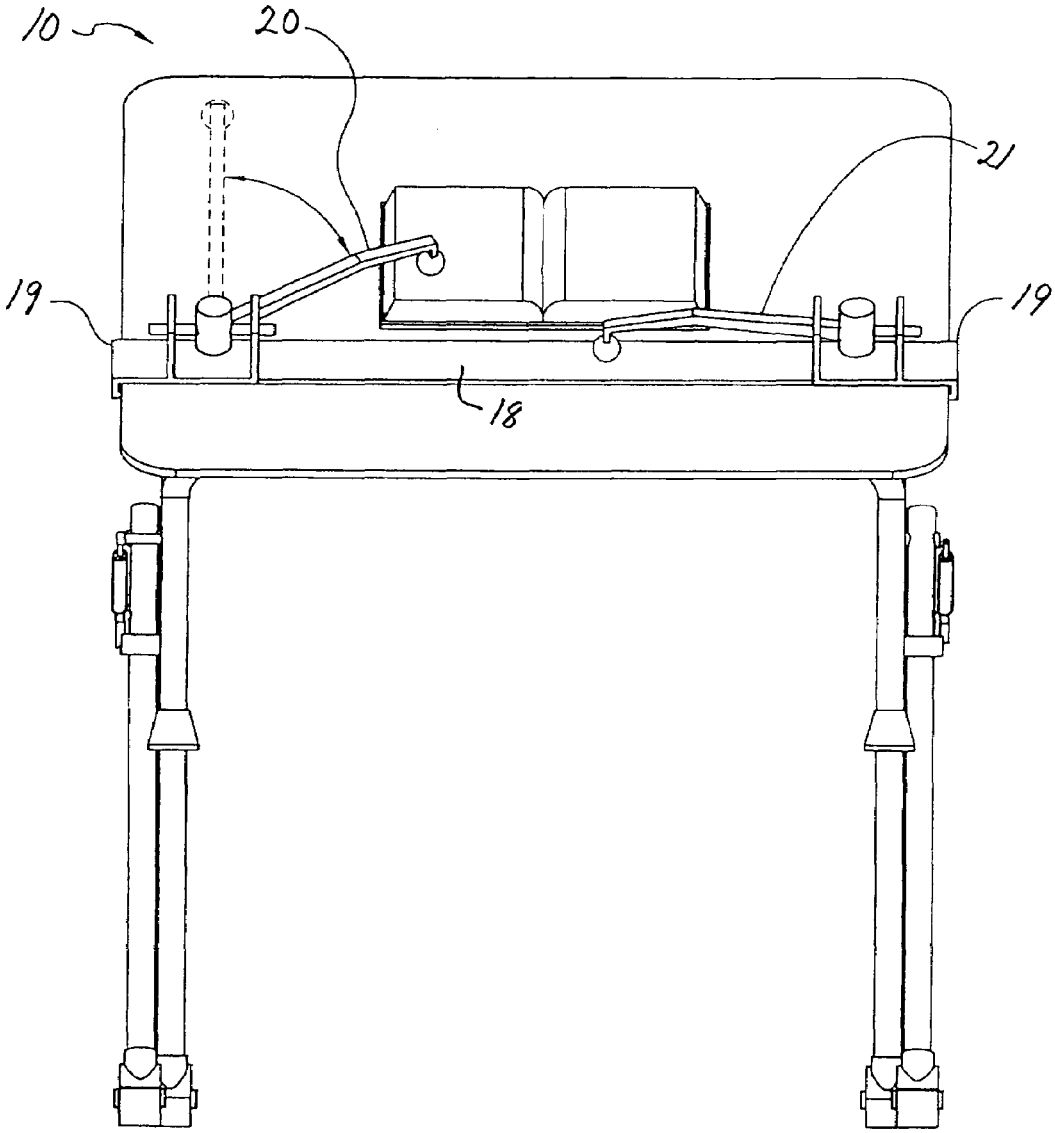
FIG. 5 is a front view of the table of FIG. 1.

The front legs 14 are pivotally connected at their top ends to the frame 12 for pivotal movement between their normal forward positions (FIG. 2) in which the table 10 is free standing, and pushed-back positions (FIG. 4).

FIG. 4 shows the table 10 pulled in by a seated user, partially over the cushion or seating surface 23 of a chair or couch, to be close to the user. The action of pulling the table in against the chair and toward the user causes the front legs 14 to pivot backward. The front legs 14 are spring-biased toward their normal forward positions by tension springs 26, each spring connected at one end to a frame member 13 and at the other end to a front leg 14. A slight push of the table away from the user allows the spring-biased front legs 14 to return to their normal forward positions, indicated in phantom in FIG. 4.

The table frame 12 includes a pair of short front legs or props 16, shorter than the front legs 14, and also height-adjustable in the same way as the other legs. The short front legs 16 are for standing on a chair or couch to help support the table when the longer front legs 14 are pivoted back out of the way, as shown in FIG. 4. The pivoted front legs 14 permit the table 10 to be drawn in close to the user (closer than stationary legs of an ordinary table would permit), whereupon the short legs 16 take over for the longer legs 14 to support the front of the table.

Figure 3:
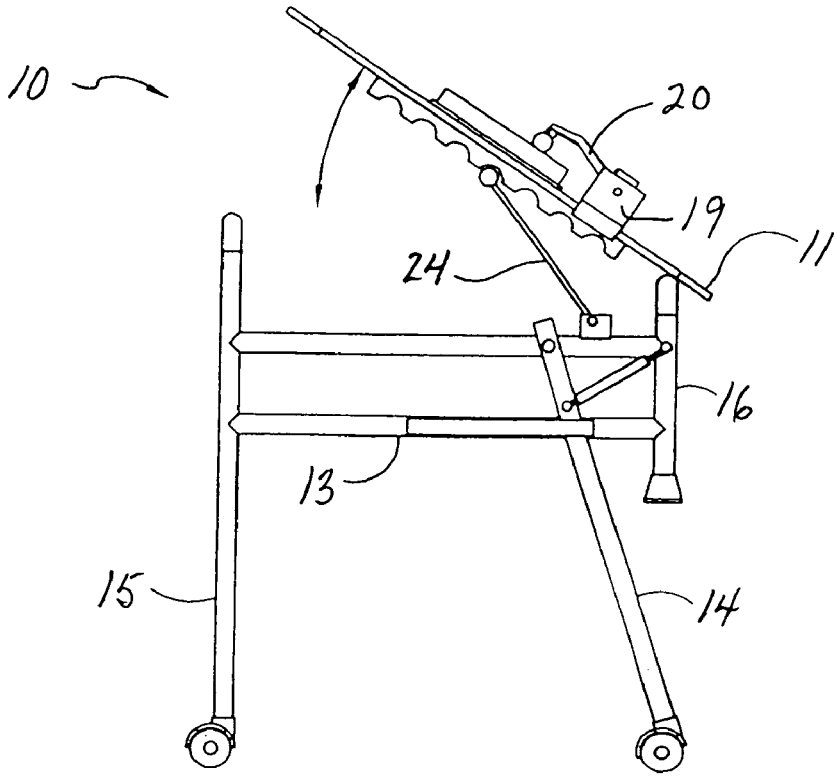

As best seen in FIG. 1, a lever 24 is pivotally mounted on the frame 12 and is spring-biased upward against a sawtooth ratchet 25 on the underside of the tabletop 11. To raise the tabletop 11 (e.g. from FIG. 2 to FIG. 3 position), the tabletop is freely pivotable upward until the spring-biased lever 24 engages the desired one of the several slots along the ratchet 25. To lower the tabletop, the lever 24 is easily depressed by thumb away from engagement with the ratchet 25 to release the ratchet and lower the table. There are two such lever/ratchet combinations, one at each end of the tabletop 11, with a crossarm (not visible) connecting them so that they operate in unison.

The table 10 further includes a crossbar 18 extending across the top and slidable on side runners 19 up and down on the table to accomodate different sizes of books, magazines, puzzles, or other objects. The crossbar 18 serves to position the book or object, and to prevent it from sliding down the inclined tabletop. Left and right hold-downs 20, 21 are slidable laterally along the crossbar 18 toward or away from the book or object. Hold-downs 20, 21 each include a spring loaded arm which is biased downward on the page of a book or magazine to hold it open. The hold-downs are easily raised and lowered (FIG. 2) to facilitate turning of pages. They are also easily swung away from the book or object to substantially clear the tabletop surface.

FIGS. 1–5 all show the table standing on a floor. Certain features of the table are also applicable for bedtable use. Except for its legs, which are stationary and shorter, the bedtable version of this invention is the same as the table of FIGS. 1–5.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A reading table, including:

a tabletop having front, back, left, and right ends, said front end supported on and connected to a frame for pivotal movement up and down among selected inclined positions;

said frame similarly having front, back, left, and right ends, and including a framework of generally orthogonal frame members supported on front and back legs, said front legs connected at their top ends to said frame for pivotal movement between "normal" forward positions and "pushed-back" positions when said table is pulled in against a chair and over the seating surface thereof, said front legs spring-biased toward said "normal" positions;

said frame further including props, shorter than said front legs, extending down at the front of said frame to stand upon said seating surface when said table is pulled in over said seating surface.

2. A reading table as defined in claim 1, in which said front and back legs are telescoped for height adjustability among a discrete number of positions, and said legs include casters on the bottom ends thereof.

3. A reading table as defined in claim 1, further including left and right levers pivotally mounted on left and right ends respectively of said frame, each of said levers engaging a ratchet on the underside of said tabletop to releasably support said tabletop at a selected incline relative to said frame.

4. A reading table as defined in claim 3, further including:

a crossbar on said tabletop, parallel to said front end thereof and slidable up and down thereon to position an object thereon; and a hold-down slidable along said crossbar, said hold-down including a spring loaded arm biased downward on said tabletop and pivotable up and away from said tabletop.

5. A reading table as defined in claim 3, including a crossbar on said tabletop, parallel to said front end thereof and slidable up and down thereon to position an object thereon; and left and right hold-downs slidable along said crossbar, each said hold-down including a spring loaded arm biased downward on said tabletop and pivotable up and away from said tabletop.

6. A reading table, including:

a tabletop having front, back, left, and right ends, said front end supported on and connected to a frame for pivotal movement up and down among selected inclined positions;

said frame similarly having front, back, left, and right ends, and including a framework of generally orthogonal frame members supported on front and back legs, said legs telescoped for height adjustability among a discrete number of positions;

left and right levers pivotally mounted on left and right ends respectively of said frame and spring-biased up against respective ratchets on the underside of said tabletop to releasably support said tabletop at a selected incline relative to said frame;

a crossbar on said tabletop, parallel to said front end thereof and slidable up and down thereon to position an object thereon; and left and right hold-downs slidable along said crossbar, each said hold-down including a spring loaded arm biased downward on said tabletop and pivotable up and away from said tabletop.

* * * * *